US006334493B2

(12) United States Patent
Lindén

(10) Patent No.: US 6,334,493 B2
(45) Date of Patent: Jan. 1, 2002

(54) CORROSION-RESISTANT THREAD JOINT FOR PERCUSSION DRILL ELEMENT AND METHOD OF ACHIEVING SUCH RESISTANCE

(75) Inventor: Johan Lindén, Gävle (SE)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/796,364

(22) Filed: Mar. 2, 2001

(30) Foreign Application Priority Data

Mar. 2, 2000 (SE) ..... 0000701

(51) Int. Cl.[7] ..... B23B 45/16; F16B 7/18

(52) U.S. Cl. ..... 173/1; 173/132; 173/171; 175/414; 403/307; 285/55

(58) Field of Search ..... 173/1, 131, 132, 173/213, 171; 175/414, 320, 327; 403/307, 343; 285/55, 422, 16; 204/167, 169, 924

(56) References Cited

U.S. PATENT DOCUMENTS 2,392,033 A 1/1946 Eaton
2,955,847 A * 10/1960 McKenna ..... 285/16
3,251,427 A 5/1966 Ewing
3,709,306 A * 1/1973 Curington ..... 173/132
4,295,751 A * 10/1981 Holmberg ..... 403/307
4,688,828 A 8/1987 Shaffer
4,760,887 A * 8/1988 Jansson et al. ..... 173/132
4,872,515 A 10/1989 Lundell
4,893,658 A * 1/1990 Kimura et al. ..... 204/167
5,064,004 A 11/1991 Lundell
5,678,698 A * 10/1997 Fontana ..... 285/55

* cited by examiner

*Primary Examiner*—Scott A. Smith
(74) *Attorney, Agent, or Firm*—Burns, Doane, Swecker & Mathis, L.L.P.

(57) ABSTRACT

A percussive drilling component includes a cylindrical male screw thread formed of a steel material. The thread includes thread crests and thread roots interconnected by thread flanks. To protect the thread against corrosion, the thread is coated with a material having a higher electrode potential than the steel material. The coating is situated at least in regions located radially inwardly of the thread flanks. The male screw thread can be attached to a female screw thread of another percussive drilling component, the female screw thread also being coated with the material.

34 Claims, 2 Drawing Sheets

CORROSION-RESISTANT THREAD JOINT FOR PERCUSSION DRILL ELEMENT AND METHOD OF ACHIEVING SUCH RESISTANCE

RELATED INVENTION

This application claims priority under 35 U.S.C. §§ 119 and/or 356 to Patent Application Serial No. 0000701-3 filed in Sweden on Mar. 2, 2000.

BACKGROUND OF THE INVENTION

The present invention relates to a drill element for rock drilling, and to a thread joint for interconnecting the drill element to other drill elements, wherein the thread joint is protected against corrosion. The invention also pertains to a method of protecting a threaded end of a drill element from corrosion.

PRIOR ART

During percussive rock drilling, the drill elements, i.e. bits, rods, tubes, sleeves and shanks adapters, are subjected to corrosive attacks. This applies in particular to underground drilling where water is used as a flushing medium and where the environment is humid. The corrosive attacks are particularly serious in the most stressed parts, i.e., thread bottoms and thread clearances. In combination with pulsating stress, caused by shock waves and bending loads, so-called corrosion fatigue arises. This is a common cause for failure of the drill element.

Today low-alloyed, case hardened steels are normally used in the drill element. The reason for this is that abrasion and wear of the thread parts have generally limited the life of the drill element. As the drill machines and the drill elements have become more efficient, problems due to abrasion and wear have diminished, and corrosion fatigue has become a major factor in limiting the life of the drill element.

The case hardening produces compressive stresses in the surface, which gives certain beneficial effects against the mechanical part of the fatigue. The resistance to corrosion in a low-alloyed steel is however poor and for that reason corrosion fatigue still happens easily.

In U.S. Pat. No. 4,872,515 or 5,064,004 a drill element is shown wherein a threaded portion is covered with a metallic material, which is softer than the steel of the drill element. Thus, it is intended to solve the problem of pitting in the threads by covering at least the parts of the thread of the drill element that cooperate with other parts of the threaded connection.

OBJECTS OF THE INVENTION

One object of the present invention is to substantially improve the resistance against corrosion fatigue of a drill element for percussive rock drilling.

Another object of the present invention is to substantially improve the resistance against corrosion fatigue in sections of reduced cross-sections in a drill element for percussive rock drilling.

Still another object of the present invention is to substantially improve the resistance against corrosion fatigue in the roots of the thread in a threaded portion in a drill element for percussive rock drilling.

SUMMARY OF THE INVENTION

The present invention relates to a percussive drilling component which has a male screw thread, as well as to the combination of that drilling component attached to another drilling component which has a female screw thread.

The percussive drilling component is formed of a steel material and includes an integral substantially cylindrical male screw thread. The thread comprises thread crests and thread roots interconnected by thread flanks. The thread is coated with a material having a higher electrode potential than the steel material. The coating on the thread is situated at least in regions located radially inwardly of the thread flanks.

In the case of the combination wherein the above-described drilling component is attached to another drilling component having a female screw thread, the female screw thread could also be coated with the high potential material, with the coating situated in regions located radially outwardly of the female thread flanks.

The invention also pertains to a method of protecting a threaded end of a steel percussive drilling component against corrosion, by coating the entire threaded end with a coating material having a higher electrode potential than the steel material, wherein the coating will be disposed on impact regions of the thread where the coating will be worn off during percussive drilling.

BRIEF DESCRIPTION OF THE DRAWINGS

The objects and advantages of the invention will become apparent from the following detailed description of preferred embodiments thereof in connection with the accompanying drawings, in which like numerals designate like elements, and in which.

DETAILED DESCRIPTION OF PREFERRED EMBODIMENTS OF THE INVENTION

Figure 1:
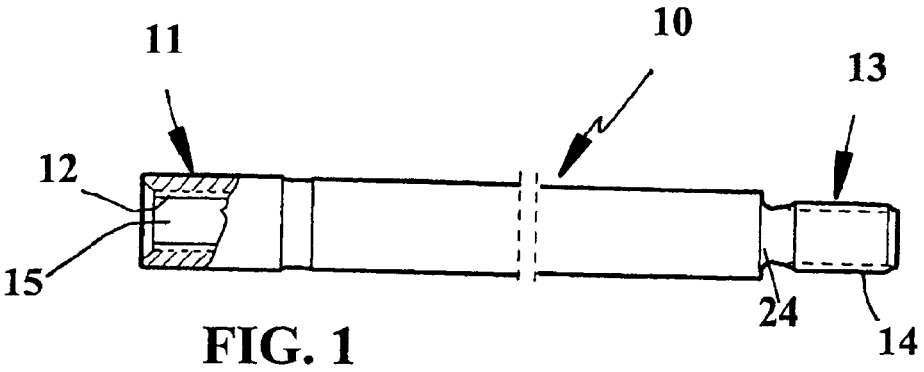
FIG. 1 shows a drill element according to the present invention in a side view, partly in cross-section.

A drill element or first drill string component 10 for percussive drilling shown in FIGS. 1 to 4 is in the form of a drill tube provided at one end with a sleeve or female portion 11 having a cylindrical female (internal) screw thread 12. The female portion 11 constitutes an integral part of the drill tube 10. At its other end the drill tube 10 is formed with a spigot or male portion 13 provided with a cylindrical male screw thread or cylindrical external screw thread 14. The shown thread is a so-called trapezoid thread but other thread shapes can be used, for example a rope thread. Furthermore, the drill element has a through-going central flush channel 15, through which a flush medium, usually air or water, is transferred.

Figure 4:
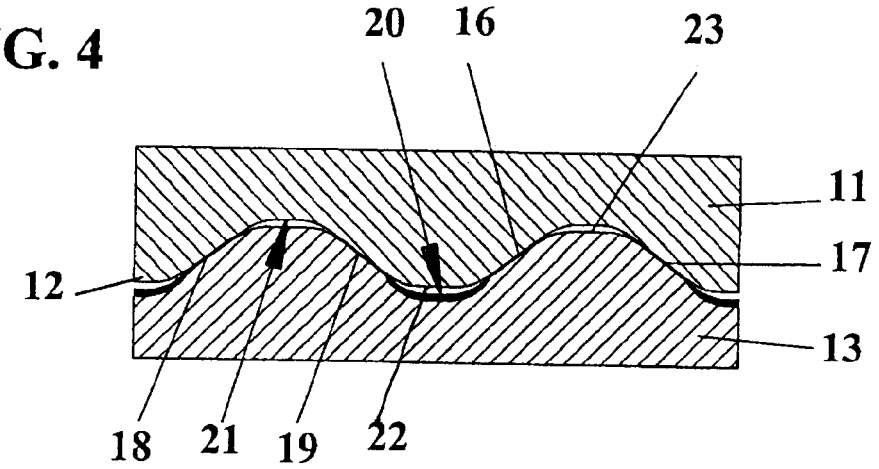
FIG. 4 shows an axial cross-section of a first embodiment of a thread joint according to the present invention.

In use, a plurality of the components 10 are screwed together, i.e., the male portion 13 of one component 10 is screwed into the female portion 11 of another, identical component 10, as depicted in FIG. 4.

The male thread 14 comprises thread flanks 16, 17 and thread roots 20 arranged between the flanks. The female thread 12 comprises the thread flanks 18, 19 and thread roots 21 arranged between flanks. In a tightened joint shown in FIG. 4 the thread roots 20 of the male thread 14 are provided substantially distant from the associated crests 22 of the female thread.

According to the present invention, regions of reduced cross-section of the male portion, e.g., the thread roots 20, restrictions 24 , and clearances, are provided with a coating formed of at least one surface-modifying, corrosion-resistant layer L. The greatest layer thickness is 0.002–5 mm, preferably 0.02–2 mm. The thread root has a first width, W1 (measured in a direction parallel to the axis of the component 10). The thread, that is the thread crest 23 and the uncoated part of the thread flanks 16, 17 have a second width, W2 (FIG. 3), wherein the ratio W1/W2 is 0.02–1.2, preferably 0.3–0.8. For example, a rope thread (of designation R35) was covered by a 5 mm thick coating (W1). The thread pitch was 12.7 mm, resulting in W2 being 7.7 mm (i.e., 12.7 minus 5). Also, W1/W2=0.65.

Said corrosion-resistant layer L in the coating of the drill element according to the invention is more electro-positive than the carrying or underlying steel of the component 10. That is, the layer has a more positive electrode potential by at least 50 mV, preferably by at least 100 mV and most preferably by at least 250 mV, in the actual environment, and thus has more resistance to corrosive attack, i.e., galvanic corrosion. Examples of such protective material are nickel, chromium, copper, tin, cobalt and titanium as well as alloys of these, preferably corrosion resistant steels or Co- or Ni-base alloys. The remaining layers can comprise binder layers in order to increase the bond between the coating and the steel.

A number of different coating methods can be used to apply the layer L, for example hot dipping, chemical or electrolytic plating, thermal spraying and welding, preferably welding by means of laser. If the threaded end of the tube 10 were dipped into a bath of the coating substance, the entire male thread would become coated. After the tube 10 has been screwed together with the female thread of another tube during the formation of a string, parts of the two threads will be in contact with one another. During a percussive drilling operation, the coating at those contact or impact regions, which is not needed, will be quickly worn off, leaving the coating intact at the regions where corrosion protection is especially needed, i.e., at the regions of reduced cross section that are exposed to corrosive attacks.

Thus, it is possible within the scope of the invention to coat most or all of the drilling component, whereafter the coating portions disposed at regions where the drilling component contacts an adjacent drilling component will wear away quickly.

EXAMPLE

Figure 2:
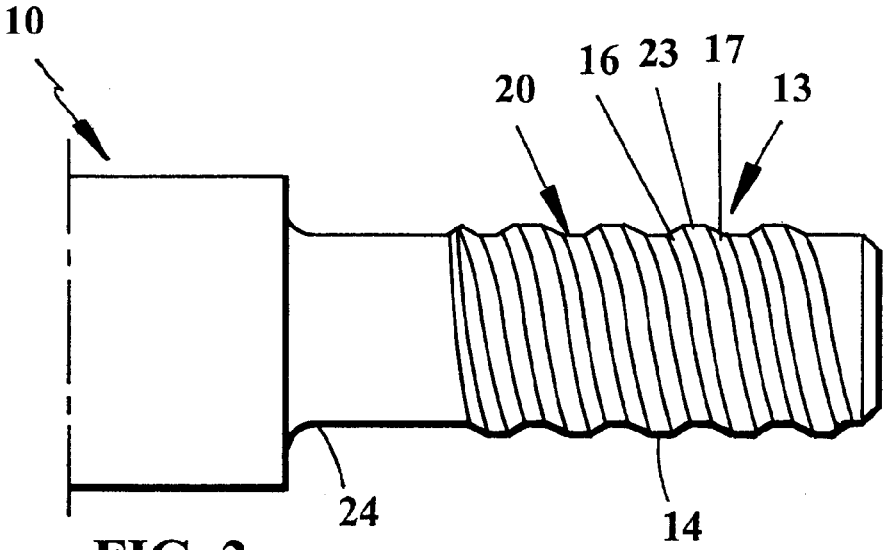
FIG. 2 shows one end of the drill element of FIG. 1 in a side view.

During so-called production drilling of long holes a drill tube 10 of about 2 m long is used, FIG. 1, which is combined with others to form a long string, i.e., six tubes of low-alloy steel were employed in the string. The critical parts of the tubes from a corrosion standpoint are the bottoms (roots) 20 of the external threads 14 (FIG. 2). Flushing water and pulsating tensile stresses lead to corrosion fatigue (galvanic corrosion) that frequently results in fracture.

Figure 3:
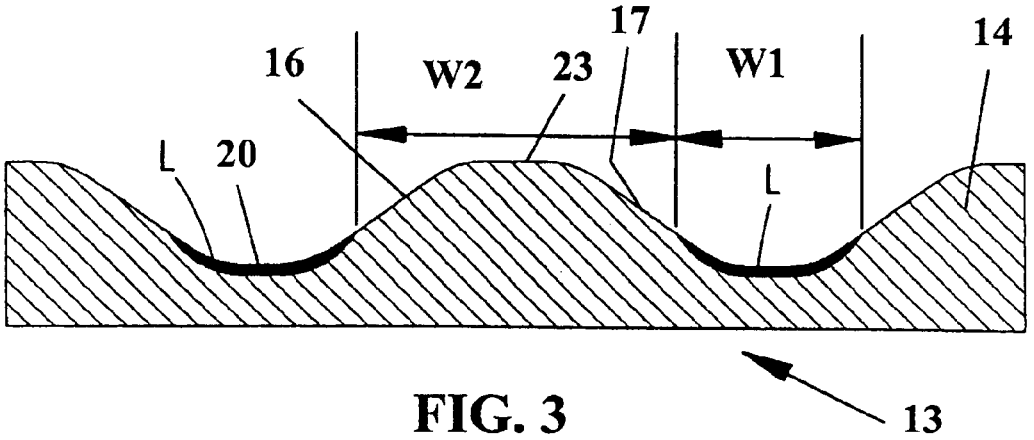
FIG. 3 shows an axial cross-section of a fragment of the end shown in FIG. 2.

The thread roots 20 of the external threads, according to FIGS. 3 and 4, were covered by a layer of maximum thickness of 0.6–0.9 mm by laser welding. Two different alloys with electrode potentials and compositions according to the table shown below were used for creating the layer, each alloy having a higher electrode potential than the low-alloy steel material of the tube.

| | % C | % Cr | % Ni | % Mo | % Fe | % Co | Electrode potential (mV)* |
|---|---|---|---|---|---|---|---|
| Test 1–4 | 0.25 | 27 | 2.5 | 6 | 1 | Rest | +200 |
| Test 5–6 | 0.03 | 21.5 | 5 | 2.7 | Rest | — | +100 |

*Approximate value in sea-water, 10° C. Corresponding values for the conventional low-alloy steel material of the tube is −500 mV (i.e., negative 500 mV).

The six tubes 10 were used together with 14 conventional tubes in the same drill string in a rig for production drilling underground and were drilled until fracture, or until the tubes were worn-out. The following life spans, measured in drilled meters, were obtained for the individual tubes 10 according to the present invention:

| | |
|---|---|
| Test 1 | 751 m, |
| Test 2 | 881 m |
| Test 3 | >1003 m |
| Test 4 | >1003 m |
| Test 5 | 892 m |
| Test 6 | 1193 m |

For tests 3 and 4 the life span was not reached due to breakage, since the drill string was stuck in the rock before any fracture occurred. The average life span for the above-captioned tests consequently became 954 m. For comparison sake, the normal life span for conventional drill tubes is about 500 m, which means that the coating of the drill element according to the present invention resulted in a striking improvement, i.e., almost a doubling of the life span.

Figure 5:
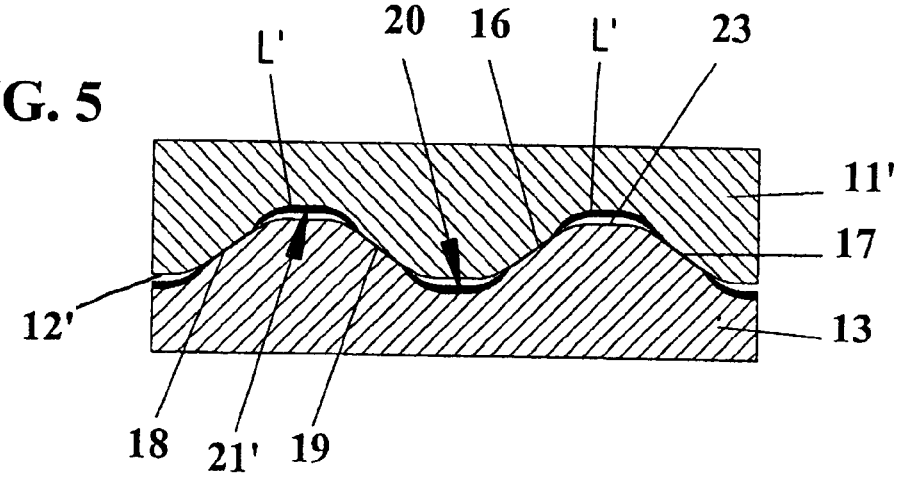
FIG. 5 shows an axial cross-section of a second embodiment of a thread joint according to the present invention.

In an alternative embodiment of a thread joint according to the present invention shown in FIG. 5 also the thread 12' of the female portion 11' would be coated with a layer of a material of higher electrode potential than the low-alloy steel, FIG. 5. In other words, sections of the female portion 11' of reduced cross-section would be provided with a coating of at least one surface-modifying, corrosion-resistant layer L. Only the most exposed portions, that is, sections of reduced cross-section such as thread roots 21', restrictions and clearances would preferably be coated. Everything stated above about the coating L, including all of the thickness and width characteristics, applies also to the case where the coating is applied to the female portion 11'. For example, the entire female thread could be dipped in a bath of coating material, whereupon the coating at the impact regions would wear away during drilling.

Figure 6:
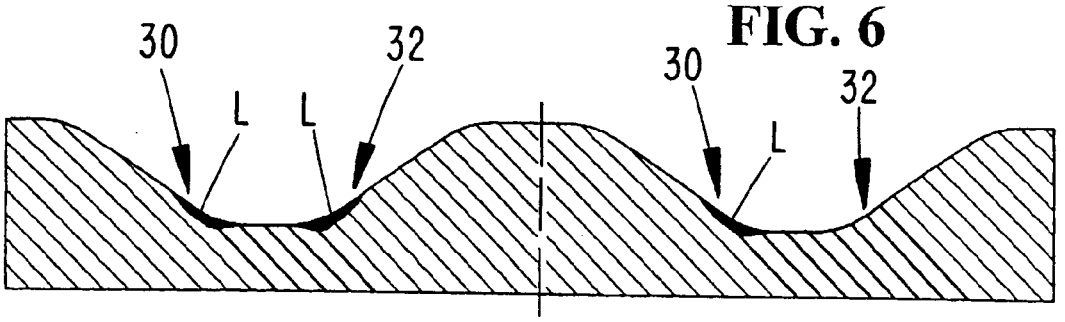
FIG. 6 shows an axial cross-section of an alternative embodiment of a drill element according to the present invention.

In another alternative embodiment of a drill element according to the present invention only the most stressed parts of the thread root would be coated. For example, as shown in the right half of FIG. 6, only one of the two transitions 30,32 between the thread root 20 and the flank of a trapezoidal thread would be provided with a layer L. Alternatively, as shown in the left half of FIG. 6, both of the transitions 30,32 could be provided with layers L.

The invention consequently relates to a thread joint and a drill element for percussive drilling with a restricted portion which is coated by a corrosion-resistant layer in order to substantially improve the resistance to corrosion fatigue. The layer is preferably discontinuous in the axial direction of the tube to avoid deposition on and softening of the thread flanks.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. In combination, percussive drilling components connected together by a thread joint defined by substantially cylindrical male and female screw threads formed integrally on respective ones of the components, the components and their respective screw threads formed by a steel material; each of the threads comprising thread crests and thread roots interconnected by thread flanks; the thread roots of the male thread being spaced from and facing respective crests of the female thread; the male thread being coated with a material having a higher electrode potential than the steel material of the male thread, the coating on the male thread being situated at least in regions thereof located radically inwardly of the thread flanks on the male thread.

2. The combination according to claim 1 wherein the coating is nickel, chromium, copper, tin, cobalt, titanium, or alloys thereof.

3. The combination according to claim 1, wherein the coating is situated only in the root of each thread; each coating having a first width W1, and separated from the next coating of the same thread by a second width W2, wherein the ratio of W1 to W2 being from 0.2 to 1.2.

4. The combination according to claim 3, wherein the ratio is from 0.3 to 0.8.

5. The combination according to claim 1, wherein the electrode potential of the coating is higher than that of the steel material by at least 50 mV.

6. The combination according to claim 1, wherein the electrode potential of the coating is higher than that of the steel material by at least 100 mV.

7. The combination according to claim 1, wherein the electrode potential of the coating is higher than that of the steel material by at least 150 mV.

8. The combination according to claim 1 wherein the coating has a maximum thickness in the range of from 0.002 to 5.0 mm.

9. The combination according to claim 1, wherein the coating has a maximum thickness in the range of from 0.02 to 2.0 mm.

10. The combination according to claim 1, wherein each coating comprises a hot dipped coating.

11. The combination according to claim 1, wherein each coating comprises a chemical plating.

12. The combination according to claim 1, wherein each coating comprises an electrolytic plating.

13. The combination according to claim 1, wherein each coating comprises a thermally sprayed-on coating.

14. The combination according to claim 1, wherein each coating comprises a weld.

15. The combination according to claim 1, wherein each coating comprises a laser weld.

16. The combination according to claim 1 wherein the female thread is coated with the same material as the male thread, the coating on the female thread being situated at least in regions thereof located radially outwardly of the female thread flanks.

17. A percussive drilling component including a substantially cylindrical male screw thread; the component and the thread formed of a steel material; the thread comprising thread crests and thread roots interconnected by thread flanks; the thread being coated with a material having a higher electrode potential than the steel material of the drilling component, the coating being situated at least in regions located radially inwardly of the thread flanks.

18. The percussive component according to claim 17, wherein the coating is nickel, chromium, copper, tin, cobalt, titanium, or alloys thereof.

19. The percussive drilling component according to claim 17, wherein the coating is situated only in the root of the thread; each coating having a first width W1, and separated from the next coating of the same thread by a second width W2, wherein the ratio of W1 to W2 being from 0.2 to 1.2.

20. The percussive drilling component according to claim 19, wherein the ratio is from 0.3 to 0.8.

21. The percussive drilling component according to claim 17, wherein the electrode potential of the coating is higher than that of the steel material by at least 50 mV.

22. The percussive drilling component according to claim 17, wherein the electrode potential of the coating is higher than that of the steel material by at least 100 mV.

23. The percussive drilling component according to claim 17, wherein the electrode potential of the coating is higher than that of the steel material by at least 150 mV.

24. The percussive drilling component according to claim 17, wherein the coating has a maximum thickness in the range of from 0.002 to 5.0 mm.

25. The percussive drilling component according to claim 17, wherein the coating has a maximum thickness in the range of from 0.02 to 2.0 mm.

26. The percussive drilling according to claim 17, wherein each coating comprises a hot dipped coating.

27. The percussive drilling according to claim 17, wherein each coating comprises a chemical plating.

28. The percussive drilling according to claim 17, wherein the coating comprises an electrolytic plating.

29. The percussive drilling according to claim 17, wherein the coating comprises a thermally sprayed-on coating.

30. The percussive drilling according to claim 17, wherein the coating comprises a weld.

31. The percussive drilling according to claim 17, wherein the coating comprises a laser weld.

32. The percussive drilling component according to claim 17, wherein each thread root forms two transitions with respective thread flanks, the coating being situated at only one of the transitions.

33. The percussive drilling component according to claim 17, wherein each thread root from two transitions with respective thread flanks, the coating being situated at both of the transitions.

34. A method of protecting a threaded end of a percussive drilling component against corrosion, the component formed of a steel material, the threaded end comprising a substantially cylindrical screw thread, the method comprising coating the entire threaded end with a coating material having a higher electrode potential than the steel material of the drilling component, wherein the coating is disposed on impact regions of the thread where the coating will be worn off during percussive drilling.

* * * * *